US007479646B2

(12) United States Patent
McGeoch

(10) Patent No.: US 7,479,646 B2
(45) Date of Patent: Jan. 20, 2009

(54) EXTREME ULTRAVIOLET SOURCE WITH WIDE ANGLE VAPOR CONTAINMENT AND REFLUX

(75) Inventor: Malcolm W. McGeoch, Little Compton, RI (US)

(73) Assignee: PLEX LLC, Fall River, MA (US)

( * ) Notice: Subject to any disclaimer, the term of this patent is extended or adjusted under 35 U.S.C. 154(b) by 220 days.

(21) Appl. No.: 11/637,205

(22) Filed: Dec. 11, 2006

(65) Prior Publication Data

US 2007/0158595 A1 Jul. 12, 2007

Related U.S. Application Data

(60) Provisional application No. 60/749,557, filed on Dec. 9, 2005.

(51) Int. Cl.
*H05G 2/00* (2006.01)

(52) U.S. Cl. ..... 250/504 R; 250/492.1; 250/493.1; 313/232; 313/163; 313/172; 313/171; 313/326; 378/119; 378/134; 378/135; 378/136

(58) Field of Classification Search ..... 250/492.1, 250/493.1, 504 R; 313/232, 163, 172, 171, 313/165, 326; 378/119, 134, 135, 136
See application file for complete search history.

(56) References Cited

U.S. PATENT DOCUMENTS 5,499,282 A 3/1996 Silfvast
6,567,499 B2 5/2003 McGeoch
6,728,337 B2 4/2004 McGeoch
6,933,510 B2 * 8/2005 Zukavishvili et al. .... 250/492.2

OTHER PUBLICATIONS

M.W. McGeoch, "Radio-frequency-preionized xenon z-pinch source for extreme ultraviolet lithography", Applied Optics, Mar. 20, 1998, vol. 37, No. 9, pp. 1651-1658.

M.W. McGeoch and C.T. Pike, "Star Pinch Scalable EUV Source", Proc. SPIE 5037, 2003, pp. 141-146.

R.W. Falcone and K.D. Pedrotti, "Pulsed hollow-cathode discharge for extreme-ultraviolet lasers and radiation sources", Optics Letters, Feb. 1982, vol. 7, No. 2, pp. 74-76.

V.M. Borisov et al., "EUV sources using Xe and Sn discharge plasmas", J. Phys. D: Appl. Phys., 37 (2004), pp. 3254-3265, IOP Publishing Ltd, UK.

(Continued)

*Primary Examiner*—Jack I Berman
*Assistant Examiner*—Michael Maskell
(74) *Attorney, Agent, or Firm*—Wolf, Greenfield & Sacks, P.C.

(57) ABSTRACT

An extreme ultraviolet source with wide-angle vapor containment and reflux is described. In the optical output directions radiating from the source plasma there is an array of tapered buffer gas heat pipes, with wick structures in the walls. In directions toward the insulators separating the discharge electrodes there are disc-shaped buffered gas heat pipes that prevent metal vapor from condensing on these insulators. A preferred electrode configuration has three electrode discs that operate in the star pinch mode. Another electrode configuration comprises two electrode discs and supports a pseudospark discharge. The star pinch variant of this source has efficiently generated 13.5 nm radiation with lithium vapor and helium buffer gas.

10 Claims, 5 Drawing Sheets

OTHER PUBLICATIONS

J. Pankert, "Philips EUV Results and Roadmap", EUV Source Workshop Santa Clara, Feb. 2004.

William Partlo et al., Proc. SPIE, Mar. 1999, vol. 3676, pp. 846-858.

C.R. Vidal and J. Cooper, "Heat-Pipe Oven: A New, Well-Defined Metal Vapor Device for Spectroscopic Measurements", J. Appl. Phys., Jul. 1969, vol. 40, No. 8, pp. 3370-3374.

Robert W. Boyd et al., "Disk-shaped heat-pipe oven used for lithium excited-state lifetime measurements", Optics Letters, Mar. 1980, vol. 5, No. 3, pp. 117-119.

Marc A. Klosner and William T. Silfvast, "High-temperature lithium metal-vapor capillary discharge extreme-ultraviolet source at 13.5 nm", Applied Optics, Jul. 20, 2000, vol. 39, No. 21, pp. 3678-3682.

Malcolm McGeoch, "Plex Source Update", Sematech EUV Source Workshop, Feb. 2005, San Jose.

Malcolm McGeoch, "Star Pinch EUV Source", Chapter 15, Extreme Ultraviolet Sources for Lithograpy, SPIE Press, Bellinghaven, WA, 2005.

J. Christiansen and Ch. Schultheis, "Production of High Current Particle Beams by Low Pressure Spark Discharges", Z. Physik A, 1979, 290, pp. 35-41.

K. Frank and J. Christiansen, "The Fundamentals of the Pseudospark and Its Applications", IEEE Trans. Plasma Sci., Oct. 1989, vol. 17, No. 5, pp. 748-753.

* cited by examiner

EXTREME ULTRAVIOLET SOURCE WITH WIDE ANGLE VAPOR CONTAINMENT AND REFLUX

CROSS REFERENCE TO RELATED APPLICATION

This application claims priority based on Provisional Application Ser. No. 60/749,557, filed Dec. 9, 2005, which is hereby incorporated by reference in its entirety.

FIELD OF THE INVENTION

This invention relates to plasma X-ray sources and, more particularly, to sources of soft X-ray or extreme ultraviolet photons.

BACKGROUND OF THE INVENTION

The extreme ultraviolet wavelength of 13.5 nm (nanometers) has been selected for use in microlithography because good reflective optics are available at this wavelength, and the prospect exists that with this wavelength very high patterning rates will be achieved for integrated circuit features as small as 20 nm. In order to achieve this goal the power from 13.5 nm light sources has to be increased several times beyond current practice, but limiting factors have to be overcome to achieve this.

The use of xenon in a Z-pinch discharge represented the first efficient plasma 13.5 nm source, with a conversion efficiency of 0.5% from stored electrical energy to 13.5 nm radiation in a 2% fractional bandwidth, radiated into a $2\pi$ steradian solid angle. However, in order to reach the initial goal of 115 W (watts) of power at an "intermediate focus" of the collimation optic that collects 13.5 nm radiation from the source, up to 700 W of 13.5 nm in-band radiation has to be emitted from the source, representing an electrical power input of 140 kW. The Star Pinch source was developed as a viable method of holding the hot plasma distant from any surface, thereby allowing powers of up to 60 kW to be handled (in principle) before the heat load became a major difficulty. However, this represented the capability to only generate one half of the initial 13.5 nm power requirement (using xenon), and did not offer the prospect of additional power scaling beyond the 115 W initial power requirement, whereas 200 W or more would be needed for future production of smaller feature sizes at higher throughput rates.

Xenon (Xe) was originally chosen because it radiated 13.5 nm light more efficiently than other gases, such as oxygen, while at the same time being a non-reactive noble gas that did not interact with the surfaces of the collection optic. However, the principal emission wavelength of xenon is not ideally placed, being at 11 nm rather than 13.5 nm, putting it outside of the range of high reflectivity optics. Other substances, such as tin ($Sn^{8+}$) and lithium ($Li^{2+}$) have their principal emissions exactly at 13.5 nm, and hence are more efficient lithography sources than Xe, but each of these is a low vapor pressure metal. The change to metals such as Sn or Li from Xe brought two major challenges: to ensure sufficient vapor density of the metal for a pinch discharge; and to prevent metallic condensation on the collection optic which would degrade its reflectivity. The first major progress toward solution of these objectives was made in relation to the formation of energetic $Li^{+}$ states via buffered heat pipe containment of metal and excitation via a pulsed hollow cathode discharge. The rewards from the change from xenon to metals in terms of 13.5 nm production efficiency were high: 2% efficiency in Sn discharges and 2% in Li discharges, with a probable efficiency increase to well above 2% once the discharge conditions in Li have been optimized. When these factor-of-four efficiency increases are considered, the 60 kW power limitation of the star pinch discharge is sufficiently high to allow production of 200 W of usable 13.5 nm radiation. The present invention introduces a way to achieve sufficient metal vapor density at the same time as preventing the escape of metal vapor through the wide angle subtended at the source by the collector optic (typically at least 2 steradians).

The use of a heat pipe with a buffer gas has long been practised as a method of heating low vapor pressure metals to achieve high vapor pressure while allowing optical observations of the spectroscopy of the metals through a cool window that does not receive metallic condensation. Initial work was with cylindrical buffered heat pipes, but the need for an angular-dependence measurement lead to the introduction of a disc-shaped buffered heat pipe, which had a cylindrical pyrex window to observe visible fluorescence. The use of any window has to be avoided for efficient collection of 13.5 nm light because all materials are strongly absorptive at this wavelength, so the use of a cylindrical buffered heat pipe with an axial aperture in place of the window was introduced in a prior experiment on the capillary discharge excitation of 13.5 nm radiation in Li. The axial aperture was differentially pumped to allow efficient optical transmission outside of the aperture in a beam tube connecting with a spectrometer. In M. A. Klosner et al., Appl. Opt. 39, pp. 3678-3682 (2000), it was suggested that a micro-capillary array of channels would allow collection of more 13.5 nm light, while maintaining the pressure differential. However, the authors did not show how to collect radiation in a large solid angle (defined as greater than one steradian) while containing the metal vapor. Additionally, the authors did not show a method of introducing the discharge current without use of high temperature ceramic-to-metal seals, which are a difficult technology at the required 800 C temperature, especially when compatibility with Li vapor is needed. Zukavishvili et al., in U.S. Pat. No. 6,933,510, discussed supply of lithium to a discharge via a wick, but did not describe an effective method of containing metal vapor in a wide angle range, so as to protect a collector optic, or arranging for its reflux back into the discharge. Accordingly, it is necessary to introduce an effective means for the production of a useful metal vapor density in plasma discharges for 13.5 nm production at the same time as providing for wide-angle collection of 13.5 nm radiation without metal vapor escape toward the collection optic.

SUMMARY OF THE INVENTION

The present invention extends buffered heat pipe containment of metal vapors into a wide viewing angle via the use of an array of tapered exit channels aligned with the path of radiation from the source, these channels being configured to condense and reflux metal vapor back into the source. Additionally, this invention combines the above exit channel geometry with disc-shaped electrodes of similar function that also reflux metal before it can reach an insulator. The use of low-temperature ceramic-to-metal seals in contact only with buffer gas is again permitted, avoiding a principal difficulty of prior work. The use of three of these disc-shaped electrodes is sufficient to realize the star pinch action that allows production of small plasma sources at increased distance from the walls, making higher power possible. Several different goals are therefore achieved at once in the subject invention.

According to a first aspect of the invention, an extreme ultraviolet source comprises: a set of at least three electrode discs separated by insulators and configured to form a star pinch plasma; a set of diverging plates aligned with rays that diverge from a central location; wicks on at least one surface of each passage between said discs or plates; heaters at or near to the inner edges of said discs or plates; cooling channels at or near to the outer edges of said discs or plates; a buffer gas filling at least part of the spaces between said discs or plates; and a working substance, infiltrated in said wicks, that said heaters evaporate to fill a central volume in which electrical impulses applied to said electrode discs form a star pinch plasma that radiates extreme ultraviolet photons.

According to a second aspect of the invention, an extreme ultraviolet source comprises: two electrode discs separated by an insulator and configured to form a pseudospark plasma; a set of diverging plates aligned with rays that diverge from a central location; wicks on at least one surface of each passage between said discs or plates; heaters at or near to the inner edges of said discs or plates; cooling channels at or near to the outer edges of said discs or plates; a buffer gas filling at least part of the spaces between said discs or plates; and a working substance, infiltrated in said wicks, that said heaters evaporate to fill a central volume in which electrical impulses applied to said electrode discs form a pseudospark plasma that radiates extreme ultraviolet photons.

DETAILED DESCRIPTION

Figure 1:
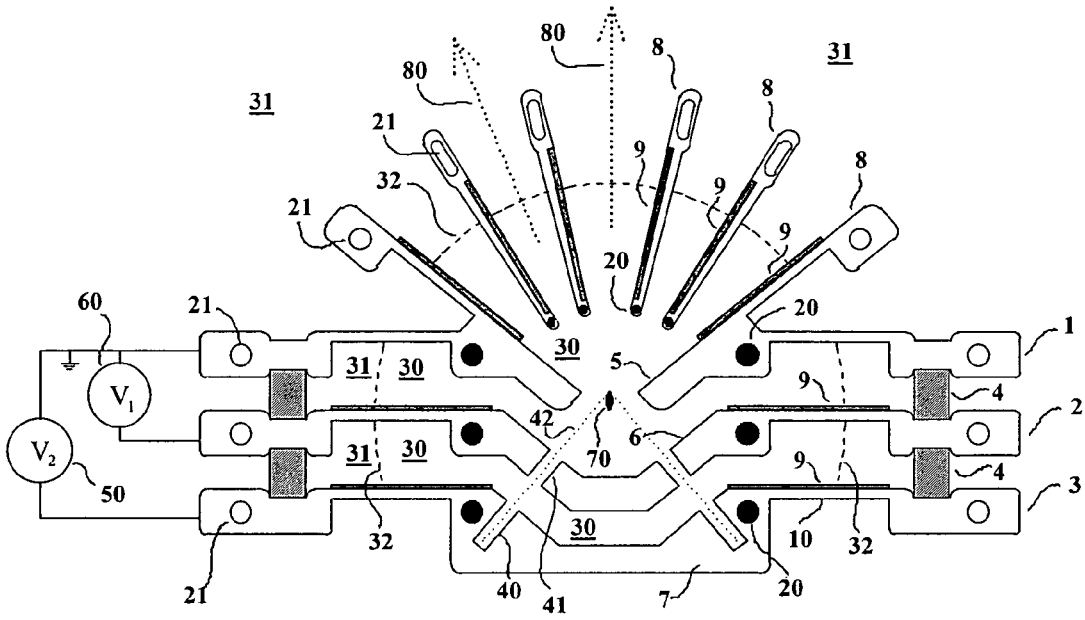
FIG. 1 shows a preferred embodiment of the invention with a star pinch electrode configuration.

Before describing the star pinch discharge action that generates 13.5 nm radiation, the basis for metal vapor control within the source will be described. With reference to the embodiment illustrated in FIG. 1, disc-shaped electrodes 1,2,3 are separated by insulators 4. A central, vertical symmetry axis describes these electrodes. Electrode 1 is the discharge anode, electrode 2 is an "inner shell" electrode, and electrode 3 is the discharge cathode. The central part 7 of cathode 3 carries an array of holes 40 that are aligned so that their axes 42 all intersect at a position 70 on the central symmetry axis. In one realization there are 12 holes in this array. The central part 6 of inner shell 2 carries a corresponding array of holes 41 aligned on axes 42 of the cathode holes. In addition to the three electrode discs, the structure comprises a nested array of surfaces 8 that together define the collection solid angle subtended by the plasma source at location 70. These surfaces are aligned with the direction of 13.5 nm radiation rays 80, so as to provide the least possible obscuration of rays 80. Although these surfaces may be conical, other constructions of the surfaces such as a tapered honeycomb or grid are understood to be possible.

Each passage between the disc-shaped electrodes 1 and 2, or 2 and 3, or between the surface elements 8 carries on at least one of its sidewalls a wick 9 that may comprise a woven mesh, porous material or set of radially aligned grooves. Symmetry about a central vertical axis implies that, for example, the wicks 9 shown on the inner shell 2 or cathode 3 have the shape of flat annular discs. The central regions of the apparatus carry heater elements 20. The outer regions of the apparatus carry coolant channels 21.

In operation, when the apparatus is assembled, sheets of the metal to be used in vapor form to produce 13.5 nm radiation are attached parallel to the wicks 9. The apparatus is filled with a low pressure of the chosen buffer gas, which is preferably helium for the lithium source, and at room temperature helium fills not only the apparatus, regions 30 and 31, but is also present 31 in the 13.5 nm propagation space. A typical pressure of helium for use with lithium is in the range of 1-2 torr.

Figure 2:
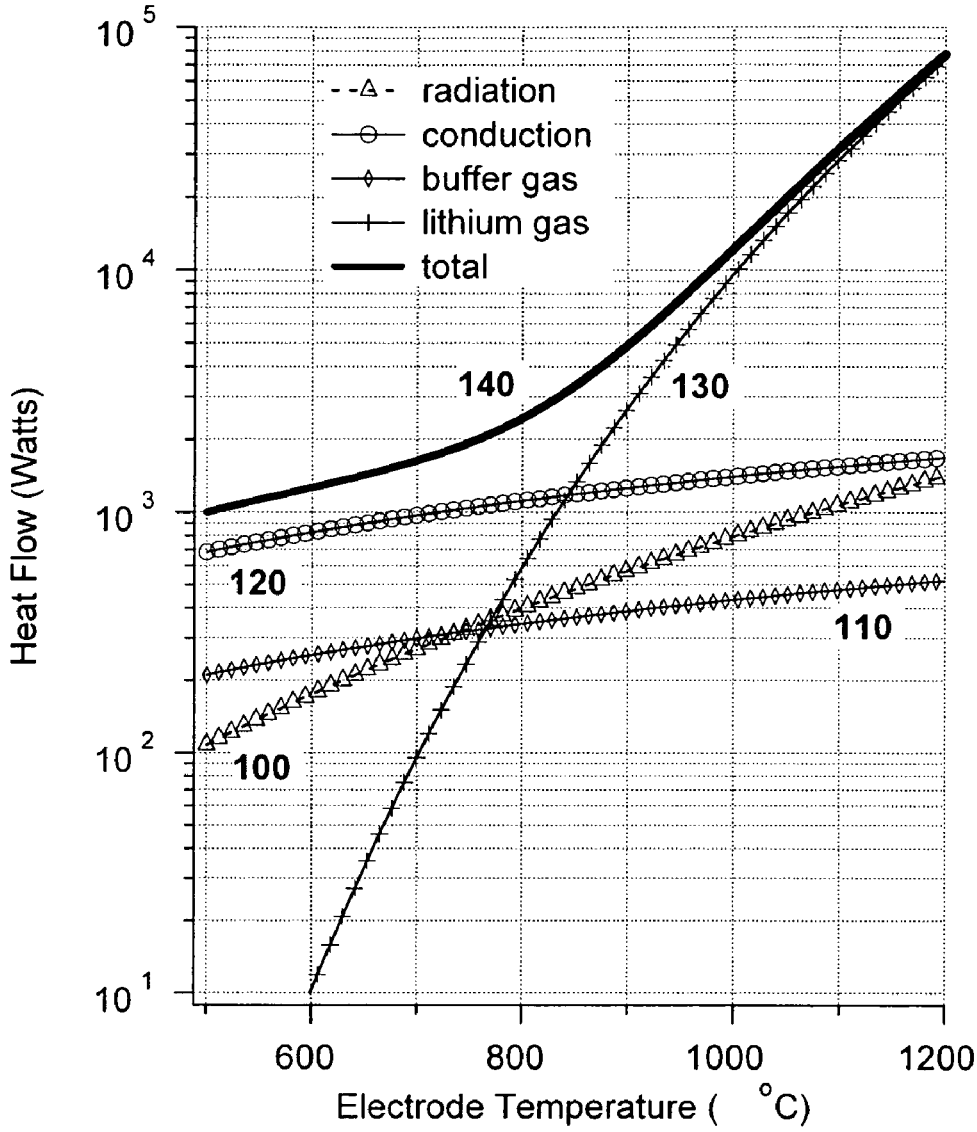
FIG. 2 shows the outward heat flows in a star pinch extreme ultraviolet source with wide-angle vapor containment.

Heat is provided by heater elements 20 in order to raise the central temperature. The temperature of the wicks also rises because thermal breaks 10, or the thin walls of structures 8, allow the wick temperature to rise well above the coolant temperature. The loaded metal then melts and infiltrates into the wicks 9. Further heating raises the metal temperature in the parts of the wicks closest to central location 70, until the vapor pressure of the metal approaches the buffer gas pressure. The heat input necessary to achieve this is shown in FIG. 2 for a realization of this source employing lithium with helium as the buffer gas that has been explored experimentally by the applicant. In that figure the different contributions to heat loss from the center to the outside of the apparatus are first shown as separate curves, and then summed to form a total. Radiation (curve 100) is a relatively small loss, as is conduction through the helium buffer (110). A larger heat flow (curve 120) is caused by conduction through the lithium-soaked wicks, and supporting thermal breaks 10. By far the largest heat flow (curve 130) at elevated temperature is due to the convection of enthalpy by lithium vapor that is evaporated in the central region, flows toward the outer regions, and condenses on the cooler outer parts of the wicks, giving up its heat. In order to reach a central temperature of 800 C, appropriate for 13.5 nm production in a star pinch of lithium vapor, a combined heat input (curve 140) of 2-3 kW is required in this realization. Lithium that has condensed on the outer parts of the wicks flows as liquid back toward the central region, to be available for re-evaporation, setting up a steady-state vapor density distribution.

Figure 3:
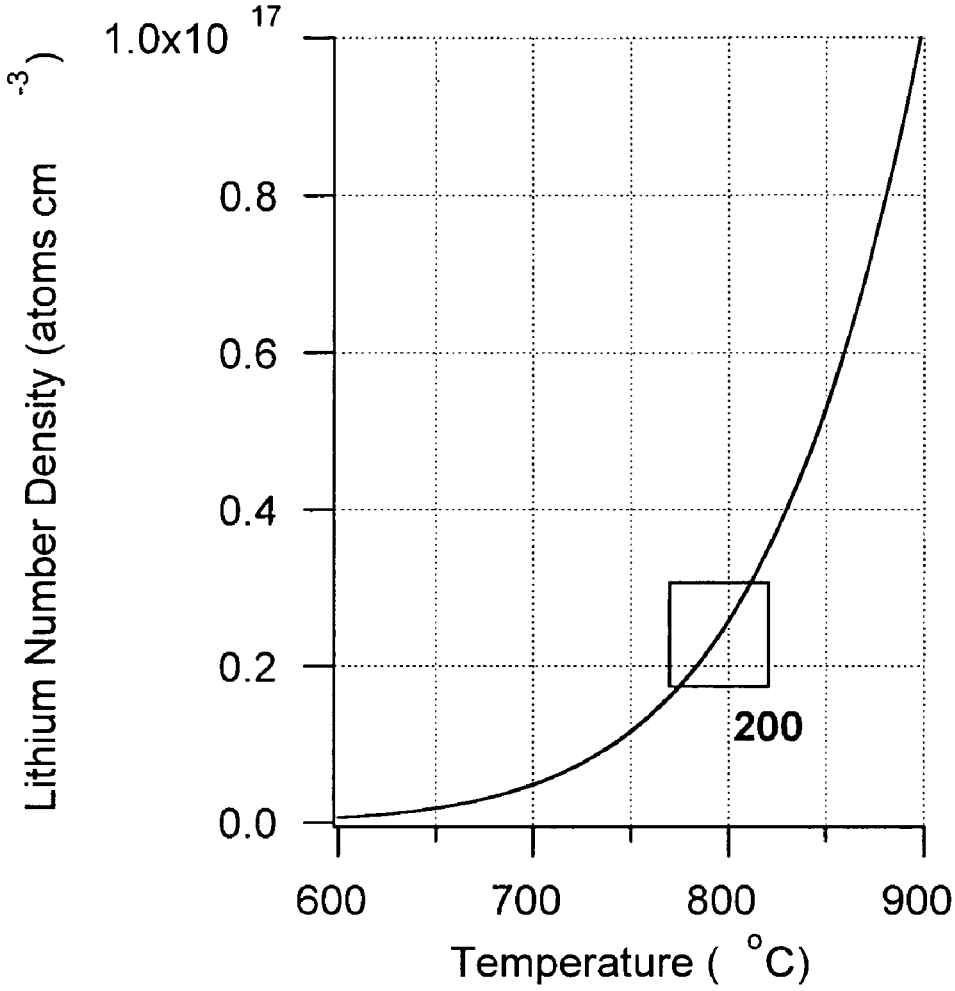
FIG. 3 shows the lithium vapor number density as a function of temperature.
Figure 4:
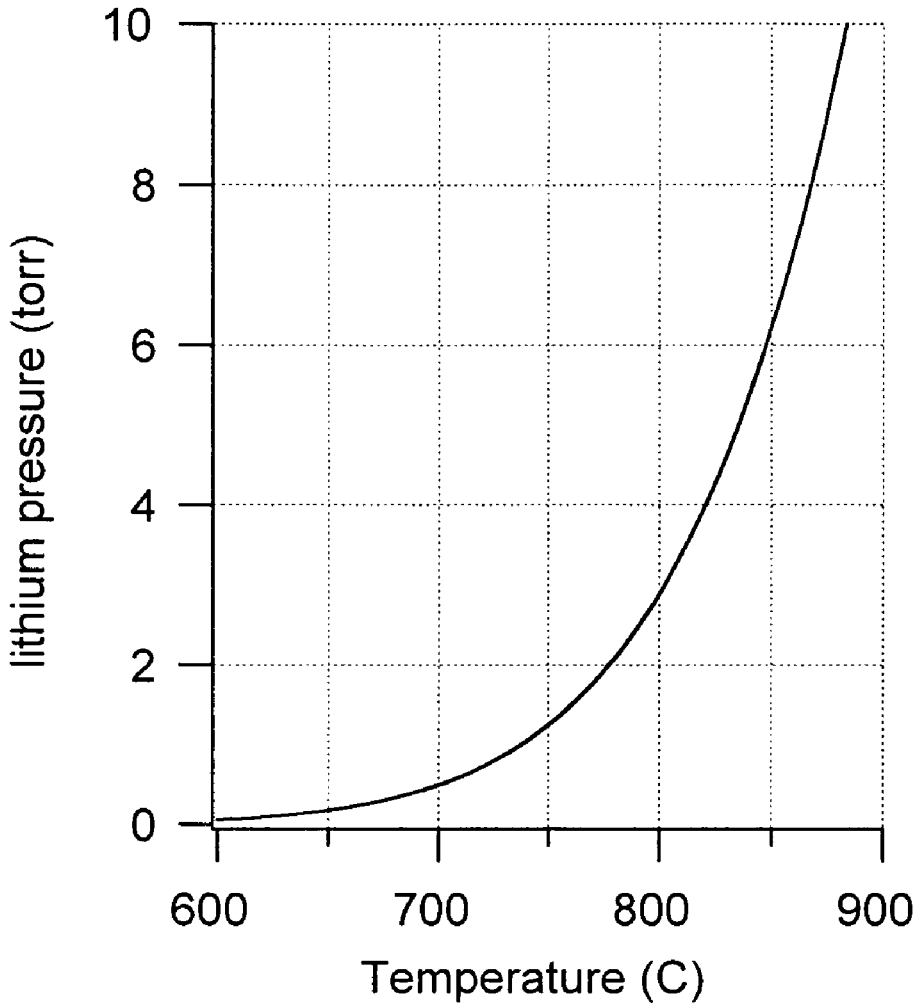
FIG. 4 shows the lithium vapor pressure as a function of temperature.

FIG. 3 shows the target range 200 for lithium vapor density in which the density of lithium metal vapor equals that of xenon gas measured for optimum 13.5 nm emission from xenon in the same discharge geometry. It is seen that this target density range corresponds to a temperature of approximately 800 C. The corresponding vapor pressure of lithium, that has to be matched by the pressure of the buffer gas, is shown in FIG. 4. A buffer gas pressure in the approximate range of 1-4 torr is required. As this temperature is approached, lithium displaces essentially all of the helium buffer in central region 30, and a relatively sharp interface 32 develops between the lithium in central region 30 and helium in outer region 31.

In a multiple-electrode lithium vapor discharge device (with two or more electrodes) there is a risk that one of the electrodes becomes cooler than the others and in consequence becomes more loaded with liquid lithium via condensation. When this happens, the thermal conductivity of this liquid lithium tends to pull the electrode temperature further down, establishing an unstable downward temperature spiral, to the detriment of the available lithium vapor pressure. Such an occurrence is prevented by use of a separate temperature control circuit for each electrode. One method to sense an electrode's temperature is to measure the electrical resistance of the heater element within the electrode, as long as this element is in good thermal contact with the body of the electrode. The resistance of refractory metal heater elements is quite a strong function of temperature. A temperature control circuit can be based on the establishment of a preset resistance within the heater element corresponding to a known temperature of the metallic resistance material. This temperature control mechanism is also necessary once significant additional power is being fed into the electrical discharges to be described below. As discharge power increases, the controller decreases power fed to the electrode in an attempt to stabilize its temperature at the preset value.

Once a refluxing equilibrium vapor density of the working metal vapor, in this case lithium, has been established, electrical pulses are applied to the electrodes to generate a hot plasma at position 70 that efficiently radiates 13.5 nm light. To facilitate this, voltage generator $V_1$ (60) is connected between anode 1 and inner shell 2. Also, voltage generator $V_2$ (50) is connected between anode 1 and cathode 3. The arrangement of electrodes and pulse generators in FIG. 1 is one realization of the star pinch, an extreme ultraviolet source type described in prior patents and publications in which several implementations of the star pinch principle have been described. The star pinch source is described, for example, in U.S. Pat. Nos. 6,567,499 and 6,728,337; M. W. McGeoch et al., Proc. SPIE 5037, pp 141-146 (2003); M. W. McGeoch, Sematech EUV Source Workshop, San Jose, (Feb. 2005); and M. W. McGeoch, Chapter 15, *Extreme Ultraviolet Sources for Lithography*, SPIE Press, Bellinghaven, W A (2005), which are hereby incorporated by reference. Although several electrical modes of operation are possible, in a preferred embodiment a direct current "keep alive" current is applied via voltage generator 60 between inner shell 2 and anode 1. Voltage generator 60 maintains inner shell 2 at a negative potential of typically between 100 and 1,000 volts relative to anode 1 while supplying a discharge current of between 10 and 1,000 mA. During this resting "keep alive" phase, voltage generator 50 is not activated, but presents effectively a low impedance between anode 1 and cathode 3, keeping them at the same potential. The "keep alive" discharge generates ions in the channels defined by axes 42 between cathode holes 40 and inner shell holes 41. These ions are accelerated toward the inner shell by its negative potential relative to the cathode. On passage through the channels and along axes 42, a proportion of these ions are neutralized by resonant charge exchange, and proceed as neutral lithium atoms toward region 70. In a second phase of operation, inner shell 2 is pulsed negative for approximately 1 microsecond via an increased current from voltage generator 60, raised to a level of 1 to 100 Amps, when additional atoms are projected toward region 70. In the final phase of operation, after an additional delay of up to several microseconds the main power pulse is applied via voltage generator 50 to the cathode 3 and anode 1. A current pulse of typically between 5 kA and 50 kA and duration typically between 100 nsec and 1 μsec is applied via a negative pulse from voltage generator 50 to cathode 3, the current flowing between cathode 3 and anode 1, via the channels through holes 40 and 41 along axes 42. During this high current pulse the low density plasma that has been pre-formed at location 70 is heated and compressed to reach an electron temperature typically in the range 10 eV to 30 eV, and an electron density typically in the range $10^{18}$ to $10^{19}$ electrons $cm^{-3}$. Under these conditions there is copious production of the $Li^{2+}$ ion that radiates on its resonance transition at 13.5 nm. The 13.5 nm light is radiated in all directions, but the forward propagating light through structures 8 can be collected and used for lithography or other purposes.

Figure 5:
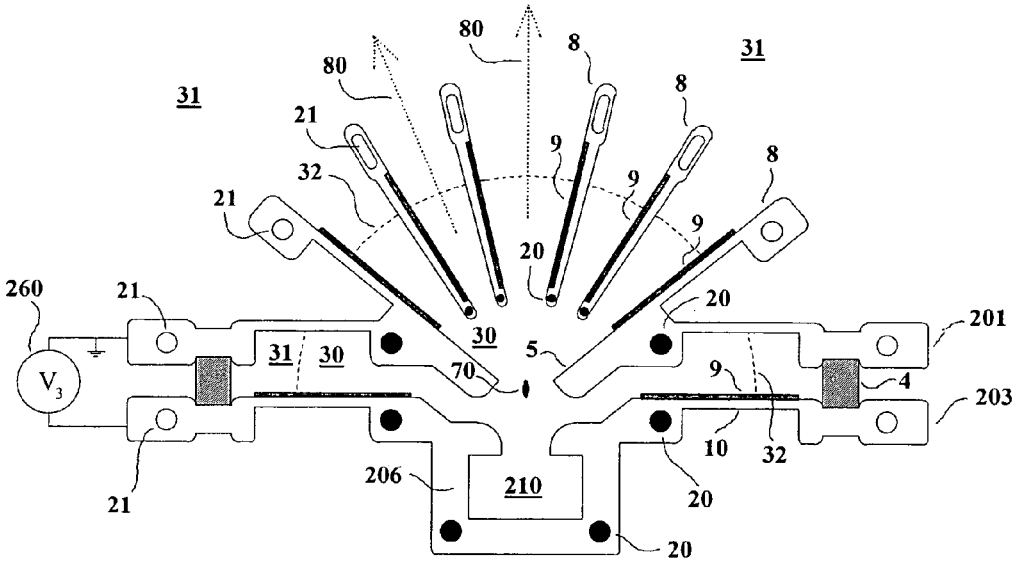
FIG. 5 shows an embodiment of the invention with a pseudospark discharge electrode configuration.

A second embodiment of the invention only has two electrode discs, so as to support a pseudospark discharge. This embodiment is illustrated in FIG. 5, in which items that correspond to items in FIG. 1 are given the same reference numbers. Anode electrode 201 is spaced from cathode electrode 203 by insulator 4. Inner region 5 of anode 201 comprises a hole and is referred to as a hollow anode. The inner region 206 of cathode 203 comprises a hollow cathode region 210. When hollow cathode 206 is opposed to hollow anode 5, and the correct conditions of vapor density and applied voltage are present, a pseudospark discharge results. This type of discharge is a form of Z-pinch that creates hot plasma conditions suitable for extreme ultraviolet emission. See, for example, J. Christiansen et al., Zeitschr. Fur Physik A 290, pp 35-41 (1979) and K. Frank et al, IEEE Trans. Plasma Sci. 17, pp 748-753 (1989), which are hereby incorporated by reference.

In addition to the two electrode discs in this embodiment, the structure comprises a nested array of surfaces 8 that together define the collection solid angle subtended by the plasma source at location 70. These surfaces are aligned with the direction of 13.5 nm radiation rays 80, so as to provide the least possible obscuration of rays 80. Although these surfaces may be conical, other constructions of the surfaces such as a tapered honeycomb or grid are understood to be possible.

The passage between the disc-shaped electrodes 201 and 203, and the passages between the surface elements 8 carry on at least one of their sidewalls a wick 9 that may comprise a woven mesh, porous material or set of radially aligned grooves. Symmetry about a central vertical axis implies that, for example, the wick 9 shown on cathode 203 has the shape of a flat annular disc. The central regions of the apparatus carry heater elements 20. The outer regions of the apparatus carry coolant channels 21.

In operation, when the apparatus is assembled, sheets of the metal to be used in vapor form to produce 13.5 nm radiation are attached parallel to the wicks 9. The apparatus is filled with a low pressure of the chosen buffer gas, which is preferably helium for the lithium source, and at room temperature helium fills not only the apparatus, regions 30 and 31, but is also present 31 in the 13.5 nm propagation space. A typical pressure of helium for use with lithium is in the range of 1-2 torr.

Heat is provided by heater elements 20 in order to raise the central temperature. The temperature of the wicks also rises because thermal breaks 10, or the thin walls of structures 8, allow the wick temperature to rise well above the coolant temperature. The loaded metal then melts and infiltrates into the wicks 9. Further heating raises the metal temperature in the parts of the wicks closest to central location 70, until the vapor pressure of the metal approaches the buffer gas pressure. FIG. 3 shows the target range 200 for lithium vapor density. It is seen that this target density range corresponds to a temperature of approximately 800 C. The corresponding vapor pressure of lithium, that has to be matched by the pressure of the buffer gas, is shown in FIG. 4. A buffer gas pressure in the approximate range of 1-4 torr is required. As this temperature is approached, lithium displaces essentially all of the helium buffer in central region 30, and a relatively sharp interface 32 develops between the lithium in central region 30 and helium in outer region 31.

Once a refluxing equilibrium vapor density of the working metal vapor, in this case lithium, has been established, electrical pulses are applied to the electrodes to generate a hot plasma at position 70 that efficiently radiates 13.5 nm light. To facilitate this, voltage generator $V_3$ (260) is connected between anode 201 and cathode 203. A current pulse of typically between 5 kA and 50 kA and duration typically between 100 nsec and 1 μsec is applied via a negative pulse from voltage generator 260 to cathode 203. During this high current pulse the low density plasma that has been pre-formed at location 70 is heated and compressed to reach an electron temperature typically in the range 10 eV to 30 eV, and an electron density typically in the range $10^{18}$ to $10^{19}$ electrons $cm^{-3}$. Under these conditions there is copious production of the $Li^{2+}$ ion that radiates on its resonance transition at 13.5 nm. The 13.5 nm light is radiated in all directions, but the forward propagating light through structures 8 can be collected and used for lithography or other purposes.

The principle of extreme ultraviolet production from a metal vapor star pinch with wide-angle vapor containment and refluxing has been reduced to practice in the laboratory of the applicant. The buffer gas used was helium and the metal lithium. Operation of the central part of the apparatus at 700 C and application of electrical pulses as described above led to the production of 4 mJ/steradian/pulse of radiation in the 13.5 nm resonance line of doubly-ionized lithium. This was repeated at 200 Hz in initial experiments, and represented an electrical conversion efficiency of 0.6%. The insulators 4 and a test surface placed beyond reflux structure 8 did not show any visible lithium condensation after six hours of operation. Higher temperatures are expected to yield increased 13.5 nm output, because the anticipated optimum lithium vapor density is approached at a temperature in the region of 800 C.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. An extreme ultraviolet source comprising:

a set of at least three electrode discs separated by insulators and configured to form a star pinch plasma;

a set of diverging plates aligned with rays that diverge from a central location;

wicks on at least one surface of each passage between said discs or plates;

heaters at or near to the inner edges of said discs or plates;

cooling channels at or near to the outer edges of said discs or plates;

a buffer gas filling at least part of the spaces between said discs or plates; and a working substance, infiltrated in said wicks, that said heaters evaporate to fill a central volume in which electrical impulses applied to said electrode discs form a star pinch plasma that radiates extreme ultraviolet photons.

2. An extreme ultraviolet source as in claim 1, in which the buffer gas is helium.

3. An extreme ultraviolet source as in claim 1, in which the working substance is lithium.

4. An extreme ultraviolet source as in claim 1, in which the temperature of each of the electrode discs and the diverging plates is independently controlled via a feedback loop.

5. An extreme ultraviolet source as in claim 4, in which the electrode temperature controller senses temperature via the resistance of the heater elements internal to the electrode discs and the diverging plates.

6. An extreme ultraviolet source comprising:

two electrode discs separated by an insulator and configured to form a pseudospark plasma;

a set of diverging plates aligned with rays that diverge from a central location;

wicks on at least one surface of each passage between said discs or plates;

heaters at or near to the inner edges of said discs or plates;

cooling channels at or near to the outer edges of said discs or plates;

a buffer gas filling at least part of the spaces between said discs or plates; and a working substance, infiltrated in said wicks, that said heaters evaporate to fill a central volume in which electrical impulses applied to said electrode discs form a pseudospark plasma that radiates extreme ultraviolet photons.

7. An extreme ultraviolet source as in claim 6, in which the buffer gas is helium.

8. An extreme ultraviolet source as in claim 6, in which the working substance is lithium.

9. An extreme ultraviolet source as in claim 6, in which the temperature of each of the electrode discs and the diverging plates is independently controlled via a feedback loop.

10. An extreme ultraviolet source as in claim 9, in which the electrode temperature controller senses temperature via the resistance of the heater elements internal to the electrode discs and the diverging plates.

* * * * *